United States Patent [19]

Kimberley et al.

[11] 3,952,711

[45] Apr. 27, 1976

[54] DIESEL INJECTION NOZZLE WITH INDEPENDENT OPENING AND CLOSING CONTROL

[75] Inventors: John A. Kimberley, East Granby, Conn.; Richard D. Kraus, Chicopee, Mass.

[73] Assignee: Ambac Industries, Inc., Springfield, Mass.

[22] Filed: Mar. 4, 1975

[21] Appl. No.: 555,243

[52] U.S. Cl. ..... 123/32 JV; 123/139 AT; 239/533

[51] Int. Cl.[2] ..... B05B 1/30; F02M 47/00

[58] Field of Search ... 123/32 JV, 139 AT, 139 AK; 239/533, 92

[56] References Cited

UNITED STATES PATENTS

| | | | |
|---|---|---|---|
| 3,587,547 | 6/1971 | Hussey et al. | 123/139 E |
| 3,625,192 | 12/1971 | Dreisin | 123/139 AT |
| 3,752,137 | 8/1973 | Kimberley | 123/139 R |
| 3,796,379 | 3/1974 | Fenne | 239/533 |
| 3,810,453 | 5/1974 | Wolfe | 123/139 AT |
| 3,831,863 | 8/1974 | Fenne | 239/533 |

*Primary Examiner*—Wendell E. Burns
*Assistant Examiner*—James W. Cranson
*Attorney, Agent, or Firm*—Howson and Howson

[57] ABSTRACT

A fuel injector for a diesel engine for use with a common rail type universal fuel injection system includes an injection piston driven by the common rail pressure fluid to inject a metered quantity of fuel through an injection nozzle. The opening of the nozzle valve is controlled by a compression spring in a conventional manner. The nozzle closing is effected by the introduction of fuel at injection pressure above the nozzle valve which acts in combination with the spring to seat the valve. In the preferred embodiment, means are provided for connecting the nozzle spring chamber with the pumping chamber of the injection piston at or slightly before the end of delivery of injected fuel to the nozzle, thereby producing a sharp cutoff of fuel flow through the nozzle. The valve spring may accordingly be selected to provide an optimum opening force rather than to satisfy the nozzle closing requirements as heretofore necessary.

9 Claims, 4 Drawing Figures

DIESEL INJECTION NOZZLE WITH INDEPENDENT OPENING AND CLOSING CONTROL

The present invention relates generally to diesel fuel injection equipment and more particularly to a novel diesel fuel injector assembly characterized by independent means controlling the nozzle valve closing forces during opening and closing of the nozzle.

For a variety of well known reasons, it is highly desirable in a diesel fuel injection system to cut off the fuel flow sharply after each injection. The conventional means for closing a diesel injection nozzle has been a compression spring acting on the nozzle valve and having a chosen spring force sufficient to close the valve despite substantial developing combustion chamber pressures. Since the spring rate is chosen at a rather high value to satisfy the requirements at full load, the required spring rate is usually much higher than would be optimum for part load operating conditions and particularly for starting of the engine. Any compromise toward a lighter spring loading results in a less effective full load nozzle closing action and a consequent deterioriation in the spray characteristics of the nozzle during the last portion of the fuel delivery.

It has been found that even a nozzle spring having a sufficient force to close the nozzle valve against the firing pressure of the engine is still not effective to efficiently deliver the last portion of the injected fuel. Although the pumping of the injected fuel may be sharply cut off, the fuel remaining in the nozzle conduits and nozzle proper briefly remains at a pressure above the closing pressure of the nozzle valve, which does not close in a typical nozzle until the residual fuel pressure drops to approximately 3,000 psi. Since modern diesel engine firing pressures might typically be on the order of 2,500 psi, the pressure drop across the nozzle spray orifices may be only about 500 psi during the final phase of delivery, which is entirely too low to provide a fuel spray of satisfactory quality.

In the present invention, an arrangement is provided wherein the means providing the control of the nozzle valve closing force is substantially independent of the means resisting the opening of the valve. Specifically, the primary means employed for closing the nozzle valve upon termination of injection is the injection pressure fuel itself, while a compression spring is the sole means employed for controlling the nozzle valve opening force.

In the preferred embodiment of the invention, each nozzle of the engine is coupled directly with a separate injector actuated by a common rail high pressure fluid. The injection piston of the injector is provided with an axial bore communicating with an annulus which is blocked during the normal injection stroke of the piston. On completion of the injection stroke, the injected fuel passage to the nozzle is blocked and the piston annulus is opened to a passage communicating with the upper end of the nozzle valve. The high force of the injection pressure fuel coupled with the lower force of the spring combine to provide a very rapid valve closing. The spring chamber pressure is reduced to ambient pressure prior to the valve opening which is resisted only by the force of the compression spring. By the appropriate selection of the compression spring, the opening force can be varied to suit the engine operating characteristics independently of the valve closing requirements.

It is accordingly a first object of the present invention to provide a diesel injector and nozzle assembly having independent means for controlling the nozzle closing force during nozzle opening and nozzle closing.

A further object of the invention is to provide an injector and nozzle assembly as described which is particularly adapted for use with a conventional type of universal fuel injection system.

A further object of the invention is to provide an injector and nozzle assembly as described which is characterized by a very sharp cutoff of fuel injection.

Still another object of the invention is to provide an injector and nozzle assembly as described wherein the fuel at injection pressure is utilized to close the nozzle valve.

Additional objects and advantages of the invention will be readily apparent from the following detailed description of an embodiment thereof when taken together with the accompanying drawings wherein.

Figure 1:
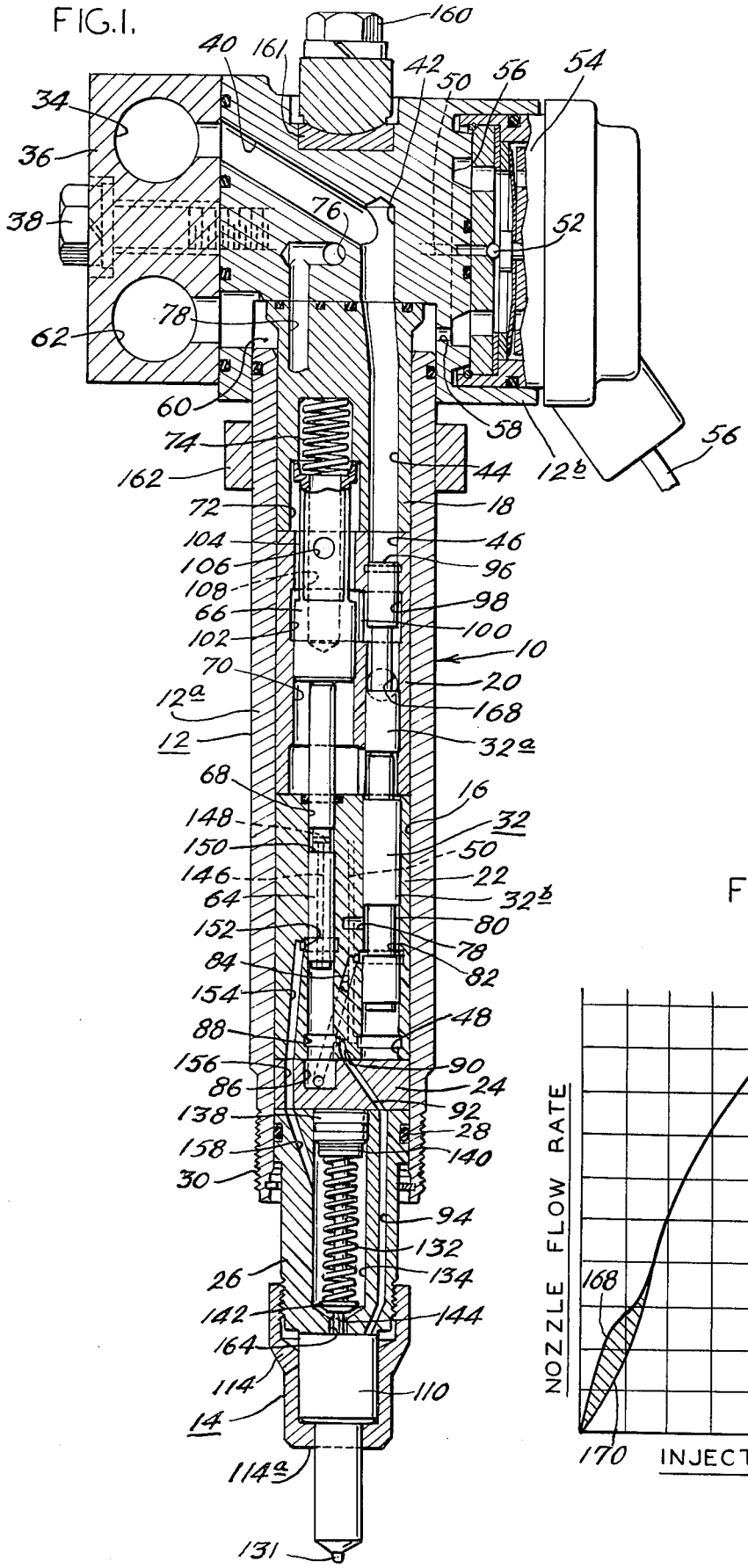
FIG. 1 is a longitudinal sectional view of an injector assembly embodying the present invention.

Referring to the drawings, FIG. 1 shows an injector assembly 10 which is structure and operation, except for the improvement of the present invention, is basically the same as the injector shown in U.S. Pat. No. 3,587,547 which is hereby incorporated by reference. The universal fuel injection system described in detail in that patent is the preferred type of system for utilization of the present invention. To briefly summarize this system, each engine cylinder is provided with a separate injector and nozzle assembly. A central fuel metering and distributing apparatus delivers metered quantities of fuel to the injectors which are actuated by an electric signal from a timing signal generator. The injectors each include an injection piston driven by a variable high pressure common rail fluid, preferably engine fuel. The illustrated injector assembly 10 is accordingly one of a number of such injectors used in a system such as shown in U.S. Pat. No. 3,587,547, the total number of injectors equalling the number of cylinders of the engine.

Considering the particular details of the injector construction with reference to FIG. 1, the injector assembly 10 comprises an injector housing 12 having a nozzle assembly 14 extending from its lower end. The housing 12 includes an elongated hollow cylindrical housing member 12*a* within which a number of axially arranged injector components are assembled, and an upper housing member 12*b* secured in sealed relation at the upper end of the housing member 12*a*. Upper, intermediate and lower barrel members 18, 20 and 22 are disposed within the bore 16 and define therewithin a number of fluid passages as well as aligned bores for the travel of the several piston members described below. The barrel members 18, 20 and 22 are secured together within the housing member 12*a* between the upper housing member 12*b* and a lower cap member 24 by means of a longitudinally extending retaining screw (not shown). The nozzle assembly and in particular the nozzle holder 26 thereof is sealed in abutting relation beneath the cap member 24 by a seal ring 28 within the lower end of bore 16. The housing member 12*a* includes external threads 30 at its lower end for mounting the injector on an engine with the tip of the nozzle assembly 14 extending into one of the engine combustion chambers.

Within coaxial longitudinal bores in the barrel members 18, 20 and 22, a servo valve 32 comprises pistons 32*a* and 32*b* disposed in end-abutting relationship. The pistons 32*a* and 32*b* move together and function much like a spool valve. The servo valve is moved to either the raised position shown in FIG. 1 or the lowered position shown in FIGS. 2 and 3 by the common rail fluid pressure bearing against the opposite (non-abutting) ends of the pistons 32*a* and 32*b*. As shown in FIG. 1, the pressurized common rail fluid is introduced through the inlet 34 in the rail member 36 which is connected to the housing member 12*b* by screw 38. The inlet 34 communicates successively with the passages 40 and 42 in the housing member 12*b* and passage 44 in the barrel member 18. The passage 44 in turn is aligned with and opens into the bore 46 in barrel member 20 within which the servo valve piston 32*a* is slidably disposed. The lower end of the bore 48 in the barrel member 22 within which piston 32*b* is slidably disposed is also connected by means of a passage (not shown) to the passage 44 so that the lower end of the piston 32*b* will also be subject to the common rail pressure. The piston 32*b* and the bore 48 are of a larger diameter than the piston 32*a* and bore 46 and the differential pressure will accordingly serve to urge the pistons into the raised position shown in FIG. 1.

To selectively provide movement of the servo valve 32, a drain passage 50 opening into the lower end of the bore 48 extends upwardly through the barrel members and into the housing member 12*b* (complete passage not shown). A ball valve 52 which is controlled by the solenoid actuator 54 normally closes the passage 50. The actuator 54 is connected with the engine timing signal generator by way of electrical line 56. Upon receiving an electrical signal, the actuator 54 opens the ball valve 52 and permits the pressurized fluid to pass into an annulus 56, passage 58 and into the drain annulus 60 from which it flows into the drain outlet 62 in the rail member 36. The position of the servo valve 32 may thus be electrically controlled by a signal to the actuator 54, the actuation of the actuator permitting the lower end of bore 48 to be opened to drain and therefore producing a lowered position of the servo valve, and a non-energized condition of actuator 54 resulting in a pressurization of the lower end of bore 48 and hence a raised position of the servo valve due to the differential pressures acting on the piston members 32*a* and 32*b*.

Also slidably disposed within the barrel members 18, 20 and 22 to the left of the servo valve 32 as viewed in the drawings are the injection piston 64 and the amplifier piston 66 disposed thereabove in axially aligned abutting relation. The injection piston 64 and amplifier piston 66 are at all times in abutting relation and could, if desired, be formed as a single element. The injection piston 64, which is of a substantially smaller diameter than the amplifier piston 66, slides within bore 68 of the barrel member 22. The upper portion of the injection piston extends into the larger bore 70 of barrel member 20 which, along with the bore 72 of barrel member 18, accommodates the amplifier piston 66 in sliding relation. A spring 74 in the upper end of bore 72 serves to dampen the upward movement of the injection and amplifier pistons.

With both the servo valve and the amplifier and injection pistons in the positions as illustrated in FIG. 1, metered fuel from the system's central fuel metering and distributing apparatus flows through inlet port 76 in the housing member 12*b* through passage 78 (passage not fully shown) in the barrel members into bore 48. An annulus 80 in the piston 32*b* permits the flow of metered fuel into bore 48 and into an annulus 82 in the bore 48 from which is passes through diagonal passage 84 into bore 86 in the cap member 24 which is coaxially aligned with the injection piston bore 68 in the barrel member 22. Accordingly, when the servo valve is in the raised position, a metered quantity of fuel will flow into the bore 86 and the lower part of bore 68 beneath the injection piston 64. On the downstroke of the injection piston, the metered fuel is driven from an annulus 88 in the bore 68 through passage 90 in barrel member 22 and aligned passage 92 in cap member 24 into the passage 94 of the nozzle holder 26 and hence out through the nozzle as explained below.

Figure 2:
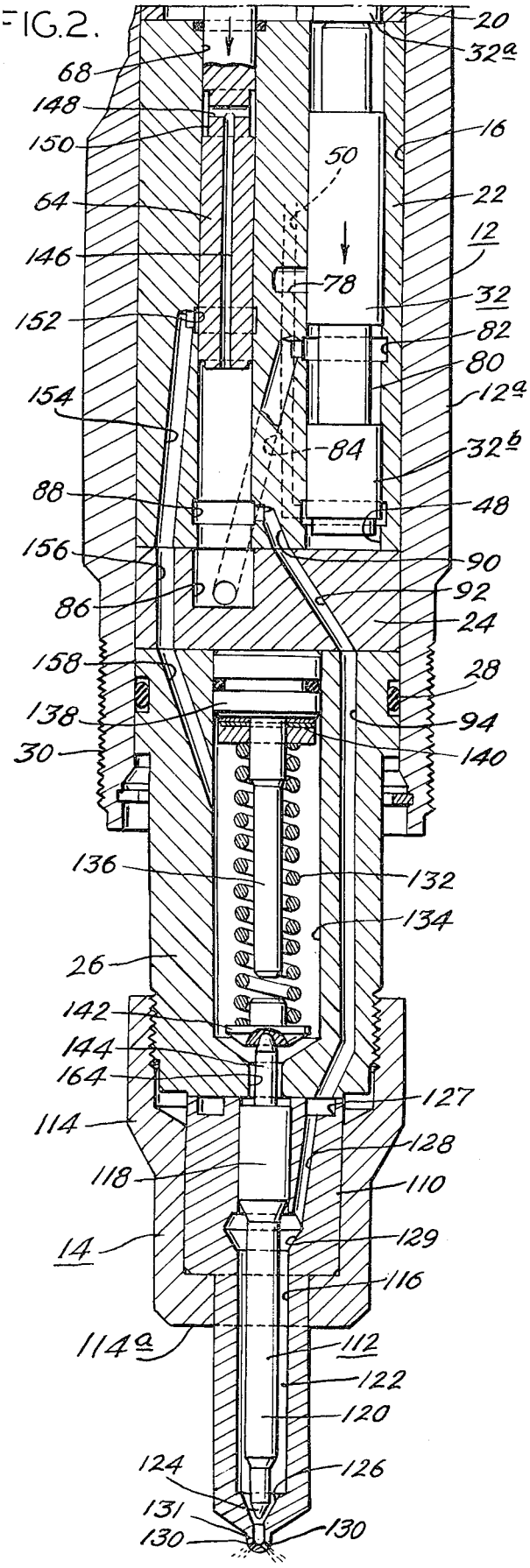
FIG. 2 is an enlarged view of the lower half of the injector shown in FIG. 1, as it appears at the beginning of the fuel injection interval.
Figure 3:
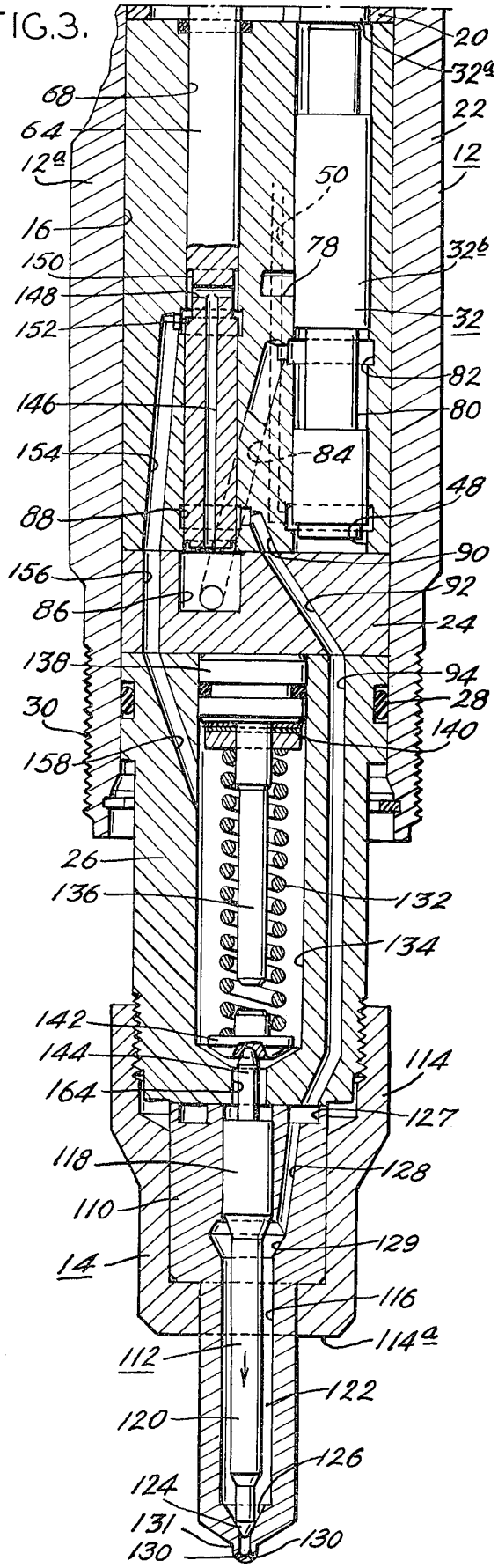
FIG. 3 is a sectional view similar to FIG. 2, showing the injector at the completion of the injection interval with the nozzle valve closed under injection pressure.

Upon the energizing of actuator 54, the servo valve 32 moves to the lowered position shown in FIGS. 2 and 3, dropping the annulus 80 below the passage 78 and thus cutting off the metered fuel passage to the injection piston bore 68. At the same time, the upper end 96 of the servo valve piston 32*a* drops below an annulus 98 in bore 46, which annulus connects through a port 100 with an annulus 102 of the bore 70. The high rail pressure thus flows from the passage 44 through the port 100 and into annulus 102 surrounding the amplifier piston 66. The amplifier piston includes a reduced diameter central portion 104 through which a port 106 opens into a hollow bore 108. The high rail pressure fuel accordingly passes through the port 106 into bore 108 and propels the amplifier piston and the abutting injection pressure downwardly at a rapid rate to inject the metered fuel into the nozzle assembly 14. The rate of fuel injection may be controlled as taught by U.S. Pat. No. 3,752,137 assigned with the present application to a common assignee.

The construction details of the nozzle assembly 14 are conventional with the exception of the modifications required for the improvement of the present invention. As shown in the enlarged views of FIGS. 2 and 3, the nozzle assembly 14 includes in addition to the aforementioned nozzle holder 26, a nozzle body 110 within which the nozzle valve 112 is mounted for reciprocatory movement. A nozzle cap 114 threadedly secures the nozzle body 110 to the holder 26. The valve 112 is disposed within a bore 116 in the nozzle body with a cylindrical upper portion 118 of the valve being in close fitting sliding engagement with the bore 116. The lower portion 120 of the valve member is of a smaller diameter, thereby forming an annular chamber 122 therearound. A conical lower end 124 of the valve is adapted to close against the conical valve seat 126 at the lower end of the nozzle body bore 116.

The fuel passage 94 in the holder 26 opens into an annulus 127 in the nozzle body which in turn communicates with a fuel passage 128 leading to an annulus 129 in the nozzle body bore 116. The fuel injected by the injection piston accordingly will flow through passage 94, annulus 127, passage 128 and annulus 129 into the annular chamber 122 around the lower portion 120 of the valve 112. The pressurized fuel acting against the necked down valve surfaces, lifts the valve tip 124 from the valve seat 126 and flows out through the orifices 130 in the nozzle tip 131 into the combustion chamber of the engine. The upward movement of the valve 112 is resisted by a compression spring 132 disposed within a bore 134 of the nozzle holder 26. The spring 132 is held in alignment by a spring guide 136 extending coaxially from the cylindrical member 138 disposed in sealed relation at the upper end of bore 134. Spacers 140 are inserted between the spring and the element 138 to provide the desired effective spring rate. At its lower end, the spring 132 bears against the spring seat 142 which in turn bears against the reduced diameter upper end 144 of the nozzle valve 112.

Figure 4:
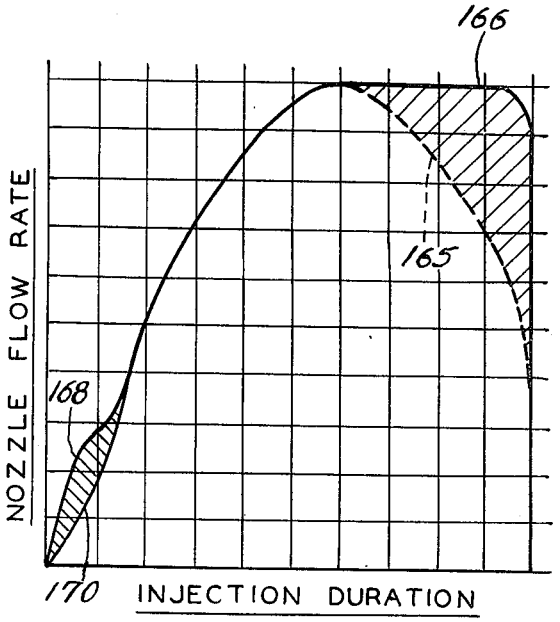
FIG. 4 is a graph showing nozzle flow rate plotted against injection duration for both the conventional injector and the injector equipped with the present invention.

The injector and nozzle structure described thus far is essentially conventional as can be gained from a study of the referenced U.S. Pat. No. 3,587,547. In the conventional injection nozzle, the force tending to seat the nozzle valve is generated solely by the spring acting on the upper end of the valve and is the same force during nozzle opening and nozzle closing. As a result, as indicated above, the spring rate must be chosen to accommodate the high closing pressures needed for full load operation but light enough to permit the nozzle to operate during engine cranking and low speed operation. Because of the need to compromise, the spring utilized in a typical nozzle, as illustrated in FIG. 4 by the broken line curve 165, is not sufficient to provide a sharp cut off of the fuel delivery.

With the improvement of the present invention, the nozzle closing force requirements for nozzle opening and closing may be separately satisfied with the result that a faster nozzle opening as well as a sharper injection cut off may be achieved. In accordance with the present invention, the structure for producing this desirable function includes means for directing fuel at injection pressure to the upper end of the nozzle valve at or just before the moment of injected fuel cut off to the nozzle. This means includes a coaxial passage 146 in the injection piston extending from the lower end thereof to a transverse passage 148 which opens into an annulus 150. The annulus 150 is blocked by the walls of bore 68 at all times except when the injection piston 64 is in the lowered position illustrated in FIG. 3 upon the completion of the injection of fuel into the nozzle, which completion takes place when the edge of the injection piston passes the lower edge of the annulus 88, thus sealing the annulus against further fuel flow. At this point or just slightly before, the annulus 150 opens into communication with an annulus 152 in the bore 68 which in turn communicates with passages 154 in barrel member 22, 156 in the cap member 24, and 158 in the nozzle holder. Passage 158 opens into the bore 134 of the holder and the upper end of the valve 112 is accordingly subject to the injection pressure upon injection cut off.

For operation, the injector is threadedly connected with an engine by means of the threaded portion 30 of the housing member 12*a*. With the rail member 36 aligned with the common rail conduit and drain conduit (not shown) which respectively connect at the ports 34 and 62, the installation of the injector is completed by tightening screws 160 which connect a bridge member 161 with the collar 162 secured to the outer wall of housing member 12*a*. The tightening of the screws 160 moves the housing member 12*b*, the barrel members 18, 20 and 22, cap member 24 and the nozzle assembly 14 downwardly until the shoulder 114*a* of the nozzle cap 114 engages a shoulder in the engine (not shown). Upon connection of the inlet port 76 with the fuel metering and distributing apparatus and the connection of electric line 56 with the timing signal generator, the injector is ready for operation.

With the actuator 54 in the non-actuated condition, the ball valve 52 is closed and the common rail pressure will be present both above and below the servo valve 32. In view of the larger diameter of the bore 48 and valve member 32*b*, the servo valve will assume the raised position shown in FIG. 1 thereby permitting a flow of metered fuel from passage 78 through the passage 84 and into the chamber beneath the injection piston. Upon receiving an electrical signal from the timing signal generator, the actuator 54 opens the ball valve 52 permitting the high pressure rail fluid beneath the servo valve to pass to drain, thereby moving the servo valve downwardly under the influence of the high rail pressure above piston 32*a*. The shift of the servo valve to its lower position simultaneously cuts off the metered fuel inlet passage 78 and opens the port 100 to permit the rail pressure to pass into the amplifier piston and move the amplifier piston and injection piston sharply downwardly, thereby driving the metered fuel through passages 90, 92 and 94 into the nozzle body. The injected fuel passes into the bore 122 and lifts the valve 112 against the force of spring 132, thereby permitting fuel to pass through the orifices 130 and into the engine combustion chamber as atomized droplets. The injector and nozzle operation described thus far is essentially conventional.

Upon or just before the point of fuel cut off to the nozzle, when the injection piston cuts off flow through the annulus 88 into passage 90, the annulus 150 opens into annulus 152 and passages 154, 156 and 158, thereby pressurizing the bore 134 of the nozzle holder to the injection pressure. Because of the oversize bore 164 through which the upper end 144 of the nozzle valve extends into the nozzle holder, the injection pressure is also present in the upper end of the nozzle holder bore 122 and acts downwardly on the nozzle valve 112.

Since the area of the nozzle valve on which the injection pressure is acting downwardly is the same as the valve area on which the injection fuel pressure in chamber 122 is acting upwardly, the nozzle valve is momentarily under the influence only of the spring 132 and thus moves downwardly with a sharp closing motion. As the valve tip engages the seat 126, the effective area against which the injection pressure acts to move the nozzle valve upwardly is substantially diminished and the area differential multiplied by the extremely high injection pressure working downwardly on the nozzle valve is more than sufficient to prevent any tendency of the nozzle valve to rebound after initially closing. The very sharp cut off achieved with this arrangement as illustrated by the curve 166 of FIG. 4. The shaded area between the curve 166 and the broken line curve 165 represents the additional amount of fuel that may be injected during the same time interval by a nozzle of the present construction.

Following the closing of the nozzle, the electrical signal to the actuator 54 is discontinued, allowing the ball valve 52 to close and causing the servo valve 32 to rise to the position shown in FIG. 1. The rising of the servo valve simultaneously opens the metered fuel inlet passage 78 permitting metered fuel to flow into the chamber beneath the injection piston and thus urge the injection piston upwardly, and at the same time closes the port 100 to the high rail pressure while opening the port 100 to a drain port 168 to permit the amplifier piston and injection piston to rise to the position shown in FIG. 1. The spring 74 dampens the upward movement of the amplifier and injection pistons and prevents the frothing of the metered fuel introduced beneath the injection piston. The rising of the servo valve and the opening of the bore 86 beneath the injection piston to the bore 48 and injection passage 78 reduces the pressure within the spring chamber bore 134 to a low ambient pressure and accordingly the spring force is the only closing force acting on the nozzle valve at the time of the valve opening. With the servo valves and the amplifier and injection pistons in the position shown in FIG. 1, the injector is then ready for the next signal from the timing signal generator which will again start the described injection cycle.

Since the spring 132 can with the present invention be selected to suit the nozzle opening requirements, a lighter spring may be utilized than conventionally required in nozzles wherein the spring is the sole closing force. As shown in FIG. 4, a heavy spring such as used in a conventional nozzle may be employed to achieve the curve 168, or a lighter spring to achieve a faster opening characteristic such as shown by curve 168. The invention accordingly permits an optimization of the nozzle opening force requirements as well as providing the desirable rapid fuel cutoff by separating the nozzle valve opening and closing control functions.

Manifestly, changes in details of construction can be effected by those skilled in the art without departing from the spirit and scope of the invention.

We claim:

1. In a fuel injection apparatus comprising a nozzle assembly having a nozzle valve, spring means for biasing said nozzle valve toward a normally closed position, conduit means for directing a metered flow of high pressure fuel into said nozzle to open said nozzle valve, and means for delivering metered fuel under a high pressure into said conduit means in timed relation with an engine operating cycle, the improvement comprising means augmenting said spring means for hydraulically closing said nozzle valve, said latter means comprising means for directing a fluid at injection pressure against said nozzle valve in opposition to said high pressure metered fuel immediately upon conclusion of said metered fuel delivery to effect a closing force on said nozzle valve in conjunction with said spring means, and means for reducing the pressure of said injection pressure fluid to a low ambient pressure prior to the opening of said nozzle valve.

2. The invention as claimed in claim 1 wherein said fluid comprises the engine fuel.

3. In a fuel injection apparatus comprising a nozzle assembly having a nozzle valve, spring means for biasing said nozzle valve toward a normally closed position, conduit means for directing a metered flow of high pressure fuel into said nozzle to open said nozzle valve, and means for delivering metered fuel under a high pressure into said conduit means in timed relation with an engine operating cycle, the improvement comprising means augmenting said spring means for hydraulically closing said nozzle valve, said latter means comprising a chamber, said valve extending into said chamber and presenting a radial surface therewithin, means for delivering a fluid at injection pressure into said chamber to effect a closing force on said nozzle valve in conjunction with said spring means immediately upon conclusion of said metered fuel delivery, and means for returning said chamber to a low ambient pressure prior to the opening of said nozzle valve.

4. The apparatus as claimed in claim 3 wherein said fluid comprises the engine fuel.

5. The apparatus as claimed in claim 3 wherein said means for delivering metered fuel under a high pressure into said conduit means comprises an injection piston.

6. The invention as claimed in claim 5 wherein said means for directing a fluid at injection pressure into said chamber comprises said injection piston.

7. In a fuel injection apparatus comprising a housing, a fuel injection nozzle extending from one end of said housing, a servo valve in said housing, an injection piston slidably disposed within a bore in said housing, an amplifier piston coaxially disposed in engagement with said injection piston, passage means within said housing for introducing metered quantities of fuel into said injection piston bore, said servo valve in a first position permitting a flow of metered fuel through said conduit means into said injection piston bore, said servo valve in a second position preventing the passage of metered fuel into said injection piston bore, conduit means within said housing for introducing a fluid at a high common rail pressure into said housing, said servo valve in its second position permitting a flow of rail pressure to act upon said amplifier piston, means for shifting said servo valve between said first and second positions to actuate said injection piston in timed relation with the engine operating cycle, a nozzle assembly including a nozzle valve, spring means for biasing said nozzle valve toward a normally closed position, and conduit means connecting said injection piston bore with said nozzle assembly to direct a metered flow of high pressure fuel thereinto to open said nozzle valve upon actuation of said injection piston, the improvement comprising means augmenting said spring means for hydraulically closing said nozzle valve, said latter means comprising a chamber, said valve extending into said chamber and presenting a radial surface therewithin, means connecting said chamber with said injection piston bore immediately upon conclusion of said metered fuel delivery to deliver fuel at injection pressure to said chamber and effect a closing force on said nozzle valve, and means for returning said chamber to a low ambient pressure prior to the opening of said nozzle valve.

8. The invention as claimed in claim 7 wherein said means connecting said chamber with said injection piston bore immediately upon conclusion of said metered fuel delivery comprises an internal passage in said injector piston connecting the fuel engaging face of said piston with an annulus spaced therefrom, and passage means connecting said chamber with said injection piston bore, said passage means and annulus communicating only upon or just prior to the conclusion of the metered fuel delivery.

9. The invention as claimed in claim 7 wherein said means for returning said chamber to a low ambient pressure prior to the opening of said valve comprises the opening of said injection piston bore to the metered fuel inlet upon the shifting of the servo valve to its first position.

* * * * *

Notice of Adverse Decision in Interference

In Interference No. 99,797 involving Patent No. 3,952,711, J. A. Kimberley and R. D. Kraus, DIESEL INJECTION NOZZLE WITH INDEPENDENT OPENING AND CLOSING CONTROL, final judgment adverse to the patentees was rendered June 9, 1978, as to claims 1–6.

[*Official Gazette October 17, 1978.*]